United States Patent [19]

Kosmahl

[11] 4,422,012

[45] Dec. 20, 1983

[54] LADDER SUPPORTED RING BAR CIRCUIT

[75] Inventor: Henry G. Kosmahl, Olmsted Falls, Ohio

[73] Assignee: The United States of America as represented by the Administrator of the National Aeronautics and Space Administration, Washington, D.C.

[21] Appl. No.: 251,009

[22] Filed: Apr. 3, 1981

[51] Int. Cl.[3] ..... H01J 25/34

[52] U.S. Cl. ..... 315/3.5; 315/3.6; 315/39.3; 333/162

[58] Field of Search ..... 315/3.5, 3.6, 3, 4, 315/5, 39.3; 333/162

[56] References Cited

U.S. PATENT DOCUMENTS

| | | | |
|---|---|---|---|
| 2,853,642 | 9/1958 | Birdsall et al. | 315/3.5 |
| 3,142,777 | 7/1964 | Sullivan | 315/3.5 |
| 3,335,314 | 8/1967 | Espinosa et al. | 315/3.5 X |
| 3,353,121 | 11/1967 | Dube | 315/3.5 X |
| 3,505,616 | 4/1970 | Picquendar et al. | 315/3.5 X |
| 3,610,999 | 10/1971 | Falce | 315/3.5 |
| 3,693,038 | 9/1972 | Scott et al. | 315/3.5 |
| 4,093,892 | 6/1978 | Vanderplaats | 315/3.5 |
| 4,263,532 | 4/1981 | Goss et al. | 315/3.5 |

*Primary Examiner*—Saxfield Chatmon, Jr.
*Attorney, Agent, or Firm*—Norman T. Musial; John R. Manning; James A. Mackin

[57] ABSTRACT

An improved slow wave circuit especially useful in backward wave oscillators includes a slow wave circuit (10) in a waveguide (12) as shown in FIG. 1. The slow wave circuit is comprised of rings 11 disposed between and attached to respective stubs (13,14). The stubs (13,14) are attached to opposing sidewalls of the waveguide (12).

To the end that opposed, interacting magnetic fields will be established to provide a very high coupling impedance for the slow wave structure, axially orientated bars (20) are connected between rings in alternate spaces and adjacent to the attachment points of stubs 13. Similarly, axial bars (21) are connected between rings in the spaces which do not include bars (20) and at points adjacent to the attachments of bars (21).

FIG. 2 shows the current loops (22,23) available because of the inventive structure.

FIG. 3 shows that rings 11 may be half rings of 180° arc.

FIG. 4 illustrates that the rings or half rings (11) with stubs (13,14) may be formed of flat metal ribbons.

12 Claims, 4 Drawing Figures

LADDER SUPPORTED RING BAR CIRCUIT

ORIGIN OF THE INVENTION

This invention was made by an employee of the U.S. Government and may be manufactured or used by or for the Government without the payment of any royalties thereon or therefor.

TECHNICAL FIELD

This invention relates to traveling wave tube (TWT) amplifiers and oscillators and is directed more particularly to submillimeter wave oscillators.

In recent years, many communication satellites have been placed in geosynchronous orbit above the earth. Recent evaluations of satellite communications indicate that in the coming decades there will be such an increasing demand for satellite-to earth communications that the capacity limits of the frequency bands of presently used satellites will be exceeded.

In order to transmit increasing amounts of information, it will be necessary to go to higher radiofrequency (rf) transmission bands. Oscillator and transmitter tubes operable in the 30/20 GHz range are presently under development. However, it is expected that in the future frequencies will eventually reach the 100 GHz to 500 GHz range. Additionally, there is presently a demand for backward wave oscillators in the 500 GHz to 2000 GHz range for applications in molecular spectroscopy.

As is well known, as the frequencies at which oscillators and amplifiers operate is increased, numerous problems are encountered, not the least of which is the accuracy required in making and positioning the mechanical parts of such devices. As an example, for the frequency range from 500 to 2000 GHz the rings of a slow wave structure for a backward wave oscillator may be on the order of from 0.001 to 0.002 inch in diameter. As a result of the extremely tight tolerances required, a high coupling impedance for the slow wave structure is highly desirable for operation in the submillimeter wave length range.

BACKGROUND ART

U.S. Pat. No. 3,993,924 to Hanf discloses a traveling wave tube having a delay line comprised of axially aligned rings supported by members which extend alternately from two facing sides of the waveguide inner walls. The rings are not connected by any axially aligned bars.

U.S. Pat. No. 3,443,146 to Buck discloses a traveling wave tube delay structure comprising a rectangular waveguide having stubs extending inwardly, alternately from a pair of opposing walls. Each stub is provided with an aperture, the apertures being coaxial with the longitudinal center of the waveguide. The metal surrounding each aperture serves as a ring. Longitudinally extending bars interconnect the rings with each bar being at a position on the ring, which position is 180° away from the position of the other bar connected to the ring.

U.S. Pat. No. 4,066,927 to Gross discloses a delay line for a traveling wave tube, particularly for use with millimeter waves. Elongated attenuating members are disposed in the respective cells defined by transverse walls. The attenuating members are matched by a suitable adjustment of matching cylinders or pins in the respective immediate adjacent line cells. The Gross patent does not disclose a conductive path in the direction of wave propagation.

U.S. Pat. No. 3,335,314 to Espinosa et al discloses a ring bar type slow wave circuit. Espinosa shows thick stubs extending perpendicularly from the walls of a waveguide to support rings. The currents in the respective stubs are predominantly transversal or perpendicular to the axis.

DISCLOSURE OF THE INVENTION

In accordance with the present invention, there is provided a slow wave structure for a millimeter wave backward wave oscillator tube. The slow wave structure is comprised of whole rings or half rings disposed in axially alignment in a waveguide. Quarter wave stubs extend from each side of each ring to the walls of the waveguide. Axially extending connecting bars are disposed in every other space between rings adjacent one side of the waveguide while a second set of axially extending bars are disposed in the remaining spaces between rings adjacent the other side of the waveguide.

The currents in the bars toward one side of the waveguide will always be in the opposite direction to the currents in the bars adjacent the other side. These currents are relatively high and due to the interaction of the magnetic fields produced result in a high coupling impedance for the slow wave structure.

BRIEF DESCRIPTION OF THE DRAWINGS

The details of the invention will be described in connection with the accompanying drawings in which.

DESCRIPTION OF THE PREFERRED EMBODIMENT

Figure 1:
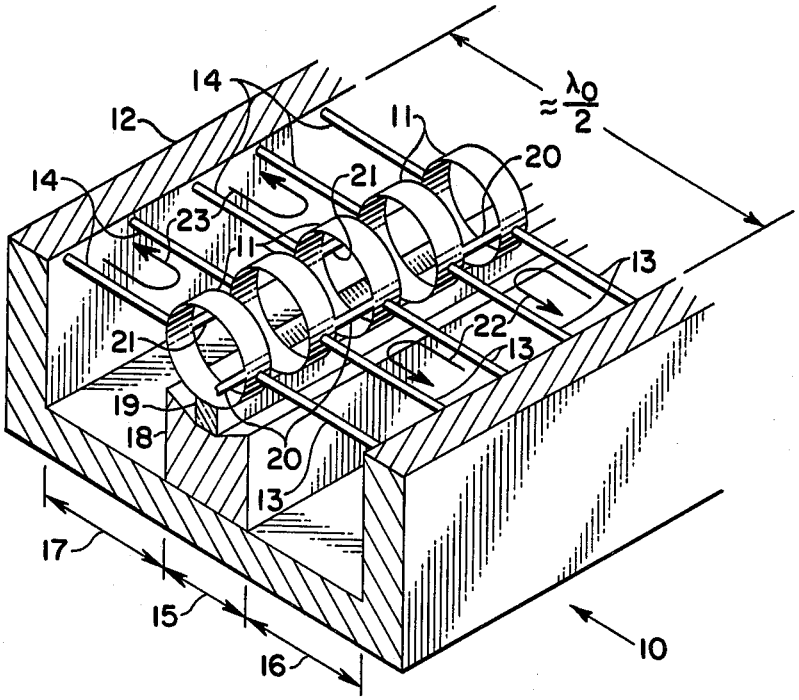
FIG. 1 is a pictorial view of a portion of a slow wave structure embodying the invention and as disposed in a waveguide with its upper half removed.

Referring now to FIG. 1, there is shown in accordance with the invention a slow wave circuit 10 comprising a plurality of rings 11 disposed in axial alignment in a rectangular waveguide 12. The rings 11 are substantially coaxial with the longitudinal center of the waveguide 12.

In order to provide desirable current flow paths, as will be described presently, a plurality of stubs 13 extend from one wall of waveguide 12, each stub being attached to a respective one of rings 11. Similarly, a second plurality of stubs 14 extend inwardly from the opposite wall of the waveguide 12, each stub being attached to a respective one of the plurality of rings 11.

The walls from which stubs 13 and 14 extend may be considered as first and second walls, respectively. The distance between the inner surfaces of the first and second walls of the waveguide 12 is approximately one-half the wavelength of the frequency $\lambda_o$ at which it is desired to operate the slow wave structure. Thus, the diameter of the rings 11 as indicated by arrow 15 plus the lengths of stubs 13 and 14 as indicated by arrows 16 and 17, respectively, is approximately one-half wavelength.

The lengths of stubs 13 and 14 are approximately one-quarter wavelength.

As is well known with traveling wave tubes, an electromagnetic wave traveling along the slow wave structure is increased in energy by a hollow beam of electrons projected through the rings of a slow wave circuit. Only structure essential to the invention is shown and discussed in FIG. 1.

In order to remove heat from the rings 11 and stubs 13 and 14 there is provided a longitudinally extending ridge 18 of electrically conducting material having high thermal conductivity. The ridge 18 is attached to a third wall of the waveguide midway between the first and second walls and is preferably copper. The width of ridge member 18 is preferably equal to diameter of the rings 11.

Disposed on top of ridge member 18 and contacting all of the rings 11 is a spacer member 19 made of a high thermal conductivity material which is electrically nonconductive. Diamond is a well-suited material for spacer 19.

To the end that the slow wave structure 10 will have an extremely high coupling impedance, axially aligned connecting bars 20 are positioned in alternate spaces between rings 11. Each bar 20 connects two rings and is attached thereto adjacent to the points of attachment of stubs 13.

In a similar manner, axially aligned connecting bars 21 are positioned between rings 11 in every other space which does not include a connecting bar 20. The connecting bars 21 are attached to rings 11 at points adjacent to the attachment of respective stubs 14.

The connecting bars 20 and 21, the stubs 13 and 14 and, also, the rings 11 are all of electrically conductive material having good thermal conductivity. In the preferred embodiment of the invention, stubs 13, 14 and connecting bars 20, 21 all lie in a common plane which approximately bisects the first and second sidewalls of waveguide 12. Thus, a bar 20 and a bar 21 attached to any particular ring 11 are at positions 180° apart on the ring. The rings 11, while shown as circular, may be slightly squashed or egg shaped in which case the major axis lies approximately in the plane of the stubs 13, 14 an the connecting bars 20,21.

The slow wave structure of FIG. 1 can be used as a forward wave amplifier at frequencies generally below 100 $GH_z$. However, it can also operate as a backward wave oscillator at frequencies generally greater than 500 $GH_z$. Because oscillators operate at relatively low power, high efficiency is not a critical parameter as it is in amplifiers.

Owing to the small size of the parts utilized in micro sized circuits such as a slow wave structure operating in the submillimeter wave range, special fabrication techniques may be required. Some of these techniques including forming the slow wave structure by vapor deposition or laser cutting. Photoetching may also be required at some point in the fabrication process.

Figure 2:
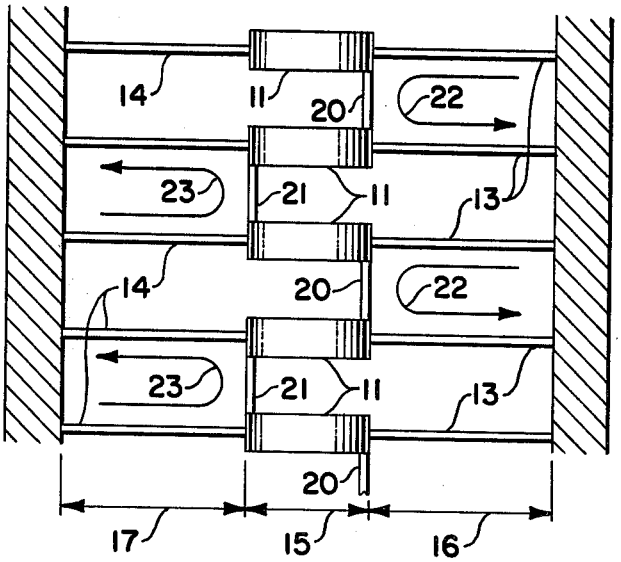
FIG. 2 is a plan view schematic diagram of a slow wave structure embodying the invention and depicting the current flow paths.

FIG. 2 is a plan view of the slow wave structure and waveguide of FIG. 1 with like parts being identified by like numerals. The arrows 22 and 23 illustrate the direction of current flow through connecting bars 20 and 21, respectively, at a given instant of time.

Current flow in the connecting bars 20 is always in an opposite direction to current flow in the connecting bars 21. During each half cycle of operation, of course, the currents will reverse direction.

Because of the physical relationship and positioning of connecting bars 20 with respect to stubs 13, a relatively strong current flow in an axial direction can be achieved. Likewise, a strong current flow in connecting bars 21 can be achieved, and at any instant of time, flows in the opposite direction to the axial current in connecting bars 20.

Because of the alternately opposing current loops 22 and 23 along the length of the slow wave structure, magnetic fields which alternate in direction from space to space between the rings 11 are produced. The interaction of these magnetic field with the traveling wave and the electron beam which is directed through the rings 11 results in a very high coupling impedance for the slow wave structure.

Figure 3:
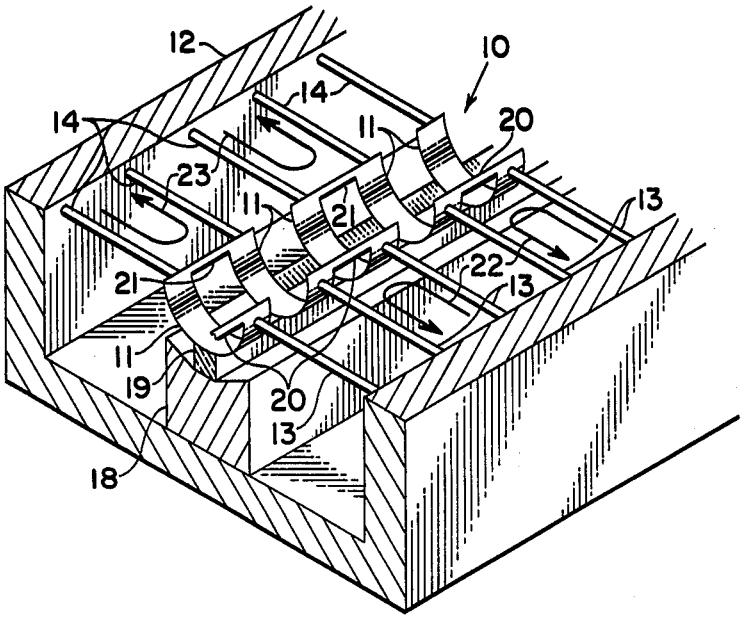
FIG. 3 is a pictorial view of an embodiment of the inventive slow wave structure utilizing half rings and shown with the upper half of the waveguide removed.

The structure shown in FIG. 3 is similar to that of FIG. 1 except that rings 11 are only half rings of approximately 180° of arc. By eliminating the upper half of the rings 11, the slow wave structure 10 of FIG. 3 can be constructed with the distance between the points of attachment of the stubs 13 and the stubs 14 to the rings 11 as small as 0.001 to 0.002 inch. With such dimensions, this slow wave structure can be used in a backward wave oscillator at frequencies in the range of from about 500 to 2000 GHz.

Because of the small dimensions required for rings 11 at submillimeter wave frequencies, removing the upper half of the rings 11 allows the electron beam to be adjusted to graze the half rings 11 without energy being dissipated by electrons which would strike the upper halves of the half rings 11 if such were used. While this arrangement facilitates transmission of the electron beam without interception, the coupling impedance is lower than for a full ring. However, the magnetic fields resulting from the mutually opposing currents in bars 20 and bars 21 partially restore the coupling impedance.

Figure 4:
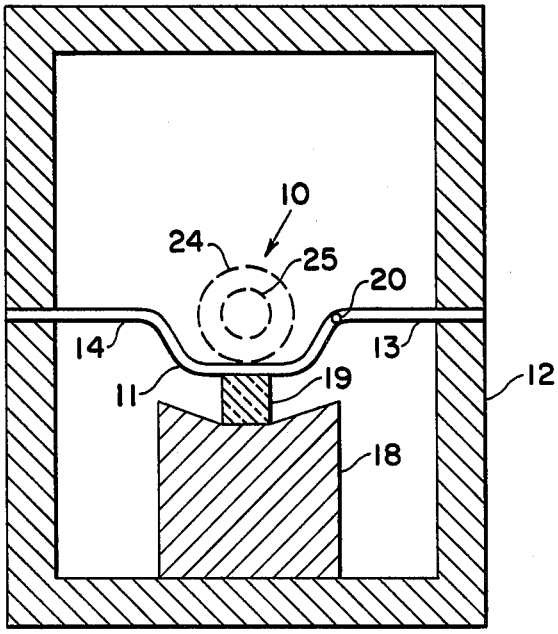
FIG. 4 is a transverse cross-sectional view of an alternate embodiment half ring version of the slow wave structure embodying the invention.

Referring now to FIG. 4, there is shown a slight modification of the half ring, slow wave structure shown in FIG. 3 and parts corresponding to those in FIG. 3 are identified by like numerals. In FIG. 4, numeral 25 identifies the longitudinal center of the waveguide 12. Numeral 24 identifies the outline of a hollow electron beam of the type used in oscillators and amplifiers such as traveling wave tubes.

As shown, one stub 13 extending from a first wall of the waveguide and one stud 14 extending from a second wall of the waveguide together with a half circle 11 are formed of a single flat ribbon of electrically conductive material. Half circle 11, as shown, is approximately one-half of a squashed circle which can be easily formed in a flat ribbon of suitable metal. Thus, rather than attaching studs 13 and 14 to half rings 11, as shown in FIG. 3, and accurately aligning the half rings, the half ring portions may be formed in flat metal ribbons which may be positioned relatively easily along the waveguide.

With regard to the slow wave structures of FIGS. 3 and 4, the connecting bars 20 and 21 are not essential when the structure is incorporated into a backward wave oscillator. However, the use of bars 20 and 21 will advantageously increase the coupling impedance.

The slow wave circuit of FIG. 1 may be made, if desired, from flat ribbons with bowed portions as shown in FIG. 4. Two metal ribbons would be used to form each ring, the ribbons being positioned in back-to-back relationship.

It will be understood that changes and modifications may be made to the above-described invention by those skilled in the art without departing from its spirit and scope as set forth in the claims appended hereto.

We claim:

1. A slow wave structure for a backward wave oscillator tube, said slow wave structure being disposed in a wave guide and comprising:

a plurality of rings disposed in axial alignment in said waveguide, said rings being coaxial with the longitudinal center of said waveguide;

a first plurality of electrically conducting stubs extending inwardly from one wall of said waveguide, each stub being attached to a respective ring;

a second plurality of electrically conducting stubs extending inwardly from a wall of said waveguide opposite said one wall, each stub being attached to a respective ring;

a first plurality of electrically conductive connecting bars extending axially in alternate spaces between said rings at the points of attachment of said plurality of stubs to respective ones of said rings; and a second plurality of electrically conductive connecting bars extending axially between said rings in the spaces not including said first connecting bars and at the points of attachment of each of said second plurality of stubs to a respective ring, whereby currents in said first connecting bars and in said second connecting bars are in opposite directions to establish magnetic fields resulting in a high impedance characteristic for said slow wave structure; and a longitudinal ridge member of electrically conducting, non-magnetic material having high thermal conductivity attached to the inside of each of third and fourth walls of said waveguide and a longitudinal spacer of an electrically nonconductive material having high thermal conductivity disposed between and contacting each ridge member and all of said rings to conduct heat away from said rings, stubs and bars.

2. The structure of claim 1 wherein said ridge members are copper.

3. The structure of claim 1 wherein said spacers are diamond material.

4. The structure of claim 1 wherein one said first plurality of stubs and one of said second plurality of stubs, both being attached to a common, ring are aligned.

5. The structure of claim 4 wherein said first plurality of stubs and said second plurality of stubs are perpendicular to the respective waveguide walls from which they extend.

6. The structure of claim 1 wherein said connecting bars are flat ribbons.

7. A slow wave structure (SWS) for a backward wave oscillator said SWS being disposed in a rectangular waveguide having first, second, third and fourth walls, said SWS comprising;

a plurality of generally half-circle, bowed members disposed in said waveguide in alignment with each other as viewed from either end of said waveguide;

a first plurality of stubs extending from said first wall of said waveguide, each of said stubs being attached to one end of a repective one of said half-circle members; and a second plurality of stubs extending from said second wall of said waveguide, each of said stubs being attached to the other end of a respective one of said half circle members; and a first plurality of electrically conductive connecting bars extending axially in alternate spaces between points on said half rings intersected by said stubs;

a second plurality of electrically conductive bars extending axially between said rings in the spaces not including said first connecting bars and at the points of attachment of each of said second plurality of stubs to a respective ring, whereby currents in said first connecting bars and in said second connecting bars are in opposite directions to establish magnetic fields resulting in a high impedance characteristic for said SWS.

8. The structure of claim 7 wherein said one and said other end of each of said half-circle members lie in a plane which bisects said first and second walls of said waveguide.

9. The structure of claim 8 wherein each of said first plurality of stubs and each of said second plurality of stubs are perpendicular to the respective walls from which they extend.

10. The structure of claim 9 wherein each half-circle and the respective ones of said first and second plurality of stubs attached to it are comprised of a continuous metal ribbon having a depressed portion substantially symmetrical to the longitudinal center of said waveguide.

11. The structure of claim 10 and including a ridge of electrically conductive non-magnetic material disposed along the wall of said waveguide nearest said half-circle and a longitudinal, electrically non-conducting spacer contacting said ridge and all of said half-circles, said spacer having high thermal conductivity whereby heat is conducted away from said half-circles and said stubs.

12. The structure of claim 1 wherein any ring and the respective ones of each of said first and second plurality of stubs connected to it are comprised of a pair of flat ribbons, each ribbon having a half circle portion, said ribbons being in back-to-back relationship.

* * * * *